US008648790B2

(12) United States Patent
Kang

(10) Patent No.: US 8,648,790 B2
(45) Date of Patent: Feb. 11, 2014

(54) LIGHT SOURCE DRIVING APPARATUS, LIGHT SOURCE DRIVING METHOD, AND DISPLAY APPARATUS

(75) Inventor: Jeong-il Kang, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 831 days.

(21) Appl. No.: 12/364,909

(22) Filed: Feb. 3, 2009

(65) Prior Publication Data

US 2009/0256786 A1 Oct. 15, 2009

(30) Foreign Application Priority Data

Apr. 15, 2008 (KR) ..... 10-2008-0034881

(51) Int. Cl.
*G09G 3/34* (2006.01)

(52) U.S. Cl.
USPC ..... 345/102; 315/307

(58) Field of Classification Search
None
See application file for complete search history.

(56) References Cited

U.S. PATENT DOCUMENTS

| | | | | |
|---|---|---|---|---|
| 7,667,683 | B2 * | 2/2010 | Chen et al. | 345/102 |
| 2006/0192728 | A1 | 8/2006 | Kim | |
| 2007/0159750 | A1 * | 7/2007 | Peker et al. | 361/93.1 |
| 2008/0231621 | A1 * | 9/2008 | Chang et al. | 345/102 |

FOREIGN PATENT DOCUMENTS

WO 2007/071033 A1 6/2007

OTHER PUBLICATIONS

C.C. Chen et al. "LED Back-Light Driving System for LCD Panels", Applied Power Electronics Conference and Exposition, Mar. 19, 2006, pp. 381-385. USA.

* cited by examiner

*Primary Examiner* — Joseph Haley
(74) *Attorney, Agent, or Firm* — Sughrue Mion, PLLC

(57) ABSTRACT

A light source driving apparatus includes: a switching driver which performs switched-mode power conversion and outputs a first current toward a light source, to control quantity of light emitted from the light source; and a current bypasser which bypasses at least a part of the first current so that a second current branched from the first current flows in the light source.

12 Claims, 5 Drawing Sheets

LIGHT SOURCE DRIVING APPARATUS, LIGHT SOURCE DRIVING METHOD, AND DISPLAY APPARATUS

CROSS-REFERENCE TO RELATED APPLICATION

This application claims priority from Korean Patent Application No. 10-2008-0034881, filed on Apr. 15, 2008 in the Korean Intellectual Property Office, the disclosure of which is incorporated herein by reference.

BACKGROUND OF INVENTION

1. Field of Invention

Apparatuses and methods consistent with the present invention relate to a light source driving apparatus, a light source driving method and a display apparatus, and more particularly, to an apparatus for driving a light source used as a backlight while displaying an image and adjusting light quantity thereof, a method thereof, and a display apparatus having the light source driving apparatus.

2. Description of the Related Art

A display apparatus such as a liquid crystal display (LCD) television, etc. is provided with a light source that is used as a backlight while displaying an image and achieved by a light emitting diode (LED) or the like. Such a display apparatus includes a light source driving circuit to drive the light source, and the light source driving circuit controls an electric current supplied to the light source so that the light source can emit light of desired quantity.

As a method for adjusting the light quantity of the light source, i.e., as a dimming method, there are a pulse width modulation (PWM) dimming method that adjusts a duty ratio of an electric current to be supplied to the light source, an analog dimming method that adjusts a peak value of the current, etc. In particular, the analog dimming method is relatively superior in efficiency and heat-generation characteristics to the PWM dimming method.

Meanwhile, the light source driving circuit includes a linear type circuit and a switching type circuit. The switching-type light source driving circuit has been widely used since it has a relatively high efficiency. FIG. 1 shows a conventional switching-type light source driving circuit. In FIG. 1, a reference numeral of 1 indicates a light source, a reference numeral of 2 indicates a light source driving circuit, and a reference numeral of 3 indicates a power source. As shown in FIG. 1, the light source driving circuit 2 includes a switching device 31 realized by a metal oxide semiconductor field effect transistor (MOSFET) or the like; an inductor 32, a diode 33, a capacitor 24, a resistor 25, and a PWM controller 26.

However, the conventional light source driving circuit 2 has to have a reactive device such as the inductor 22 and the capacitor 24 since it is the switching type. Accordingly, there is a problem of a slow response because decrease of an output current Io relies on natural discharge of energy stored in the reactive device when to decrease the output current Io.

For example, in the case where the analog dimming method is applied to the light source driving circuit 2, as shown in FIG. 2, the current Io flowing in the light source 1 in response to a square-wave analog dimming signal has a considerably long response delay d in a falling edge.

SUMMARY OF THE INVENTION

Accordingly, it is an aspect of the present invention to provide a light source driving apparatus, a light source driving method and a display apparatus, which are improved in response characteristics of an output current while maintaining good efficiency and heat-generation characteristics.

The foregoing and/or other aspects of the present invention can be achieved by providing a light source driving apparatus including: a switching driver which performs switched-mode power conversion and outputs a first current toward a light source, to control quantity of light emitted from the light source; and a current bypasser which bypasses at least a part of the first current so that a second current branched from the first current flows in the light source.

Magnitude of the at least a part of the first current may be set to make the second current reach a predetermined target value.

The target value of the second current may correspond to an input signal of the switching driver.

The at least the part of the first current may correspond to difference between the first current and the target value.

The current bypasser may include: a transistor which is connected in parallel with the light source; and a transistor controller which controls the transistor so that the at least the part of the first current flows in the transistor.

The transistor controller may include an error amplifier to control the transistor to decrease difference between a first voltage corresponding to the second current and a second voltage corresponding to the target value.

The current bypasser may include: a resistor which is connected in series with the light source; and a differential amplifier which detects voltage difference across the resistor and outputs the voltage difference as the first voltage.

The switching driver may perform at least one of analog dimming and pulse width modulation (PWM) dimming to control the quantity of the light.

The light source may include at least one light emitting diode (LED).

The foregoing and/or other aspects of the present invention can be achieved by providing a method of driving a light source, including: performing switched-mode power conversion and outputting a first current toward the light source, to control quantity of light emitted from the light source; and bypassing at least a part of the first current so that a second current branched from the first current flows in the light source.

Magnitude of the at least a part of the first current may be set to make the second current reach a predetermined target value.

The target value of the second current may correspond to an input signal of the switched-mode power conversion.

The at least the part of the first current may correspond to difference between the first current and the target value.

The bypass of the at least the part of the first current may include bypassing the at least the part of the first current to decrease difference between a first voltage corresponding to the second current and a second voltage corresponding to the target value.

The bypass of the at least the part of the first current may include: detecting voltage difference across a resistor which is connected in series with the light source; and outputting the voltage difference as the first voltage.

The performing and outputting may include performing at least one of analog dimming and pulse width modulation (PWM) dimming to control the quantity of the light.

The light source may include at least one light emitting diode (LED).

The foregoing and/or other aspects of the present invention can be achieved by providing a display apparatus including: a video processor which processes an image; a display unit which displays the image processed by the video processor; a light source which illuminates the display unit with light; and a light source driver which drives the light source to control quantity of the light emitted from the light source, the light source driver including: a switching driver which performs switched-mode power conversion and output a first current toward a light source; and a current bypasser which bypasses at least a part of the first current so that a second current branched from the first current flows in the light source.

Magnitude of the at least a part of the first current may be set to make the second current reach a predetermined target value.

The target value of the second current may correspond to an input signal of the switching driver.

The at least the part of the first current may correspond to difference between the first current output and the target value.

The current bypasser may include: a transistor which is connected in parallel with the light source; and a transistor controller which may control the transistor so that the at least the part of the first current flows in the transistor.

The transistor controller may include an error amplifier to control the transistor to decrease difference between a first voltage corresponding to the second current and a second voltage corresponding to the target value.

The current bypasser may include: a resistor which is connected in series with the light source; and a differential amplifier which detects voltage difference across the resistor and outputs the voltage difference as the first voltage.

The switching driver may perform at least one of analog dimming and pulse width modulation (PWM) dimming to control the quantity of the light.

The light source may include at least one light emitting diode (LED).

BRIEF DESCRIPTION OF THE DRAWINGS

The above and/or other aspects of the present invention will become apparent and more readily appreciated from the following description of the exemplary embodiments, taken in conjunction with the accompanying drawings, in which.

DETAILED DESCRIPTION OF EXEMPLARY EMBODIMENTS OF THE INVENTION

Figure 3:
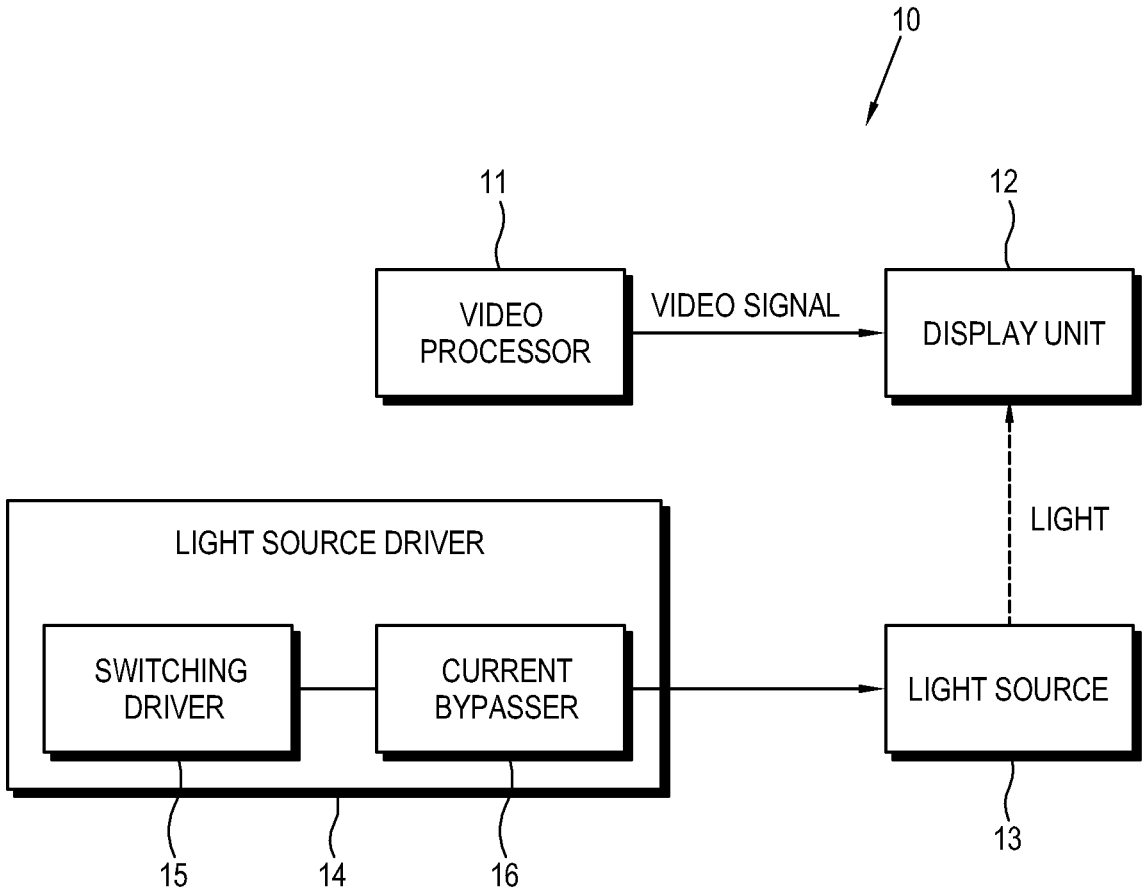
FIG. 3 is a block diagram of a display apparatus according to an embodiment of the present invention.

Below, an exemplary embodiment of the present invention will be described in detail. FIG. 3 is a block diagram of a display apparatus 10 according to an embodiment of the present invention. For example, the display apparatus 10 may include a television, a monitor, etc. and processes an input video signal to display an image.

As shown in FIG. 3, the display apparatus 10 includes a video processor 11 to process a video signal, and a display unit 12 to display an image based on the video signal processed by the video processor 11. The process in the video processor 11 may include decoding, image enhancement, scaling, adjustment of brightness, contrast, etc. and so on. The display unit 12 may include a display panel of a liquid crystal display (LCD) type.

Further, the display apparatus 10 includes a light source 13 used as a backlight for the display unit 12, and a light source driver 14 to drive the light source 13. The light source 13 includes at least one light emitting diode (LED). The light source 13 includes an edge-type light source placed in at least one edge of the display panel, and a direct-type light source placed behind the display panel. The light source driver 14, which is described as an example of a light source driving apparatus according to an exemplary embodiment of the present invention, may be achieved in the form of an independent printed circuit board (PCB) provided with at least one circuit device. Alternatively, the light source 13 and the light source driver 14 may be realized as a single apparatus.

The light source driver 14 controls an electric current to be supplied to the light source 13 so that the light source 13 can emit light of desired quantity. The light source driver 14 employs a pulse width modulation (PWM) dimming method as well as an analog dimming method to adjust the light quantity of the light source 13.

To control the light quantity of the light source 13, the light source driver 14 includes a switching driver 15 that performs switched-mode power conversion to adjust magnitude of a first current to a predetermined target value, and a current bypasser 16 that bypasses at least a part of the first current output from the switching driver 15 so that a second current can reach the target value. In this embodiment, the target value of the second current is equal to that of the first current, and corresponds to an input signal of the switching driver 15 (refer to Iref in FIG. 4).

Besides, although they are not shown here, the display apparatus 10 may includes at least one of a tuner to receive the video signal such as a broadcasting signal; a signal input unit provided with connectors corresponding to various signal formats so as to receive the video signal from a digital versatile disc (DVD) player or the like video processing device; a sound output unit such as a loud speaker to output sound; a user input unit such as a remote controller, a control panel, etc. to receive inputs from a user; a storage unit such as a flash memory, a hard disk drive, etc. to store video data and/or audio data; a communication unit to communicate with network or other communication devices; a power supply to supply power to such components; and a controller that includes a read only memory (ROM), a random access memory (RAM) and a central processing unit (CPU) and a least one software program to control these components.

Figure 4:
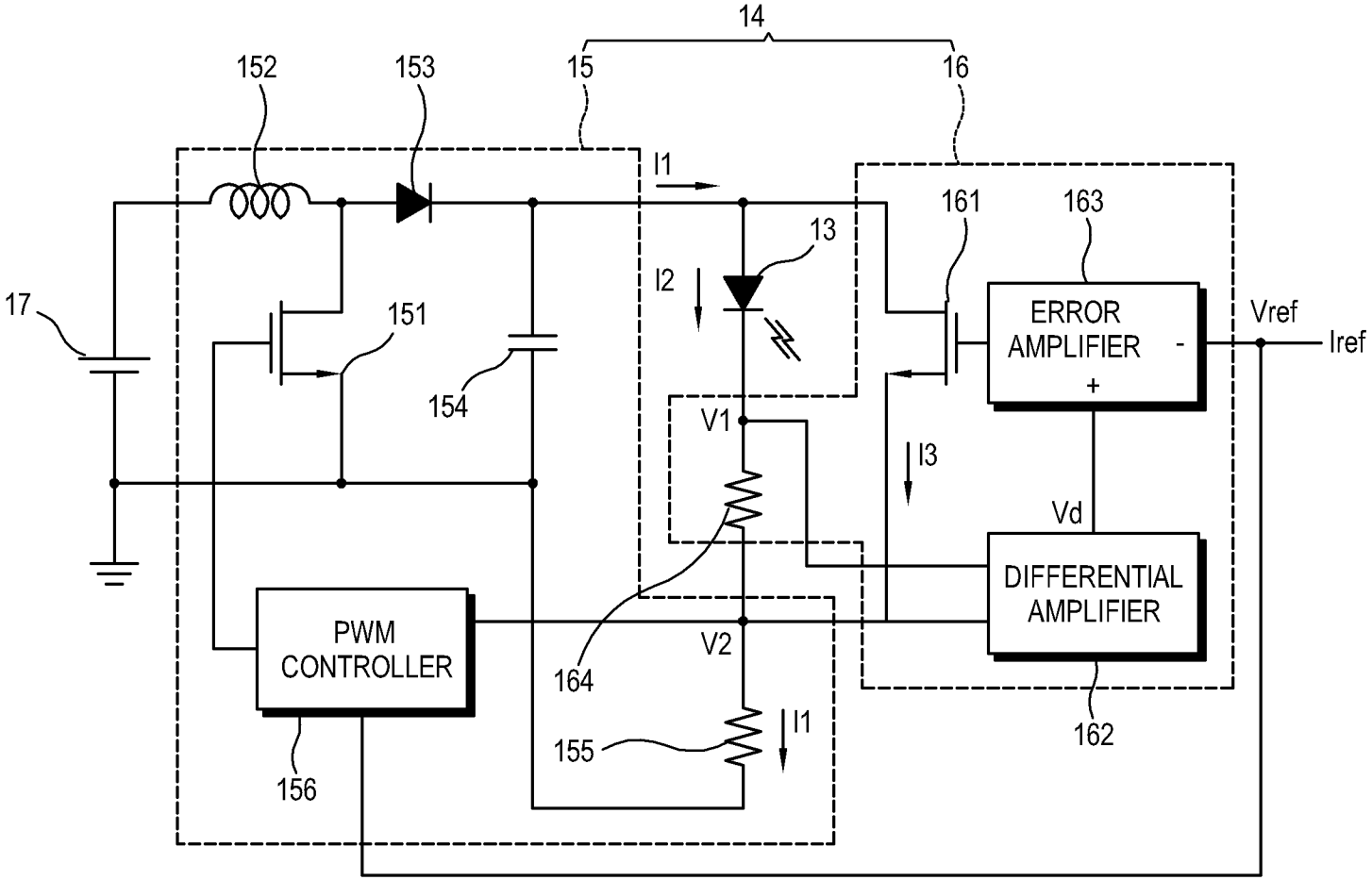
FIG. 4 is a circuit diagram of a light source driver in the display apparatus of FIG. 3.

Below, the light source driver 14 according to an exemplary embodiment of the present invention will be described in more detail. FIG. 4 is a circuit diagram of the light source driver 14 according to an exemplary embodiment of the present invention. In FIG. 4, a reference numeral of 17 indicates a power source.

As shown in FIG. 4, the light source driver 14 includes the switching driver 15 to perform the switched-mode power conversion. In this embodiment, the switching driver 15 includes a direct current (DC)-DC converter of a boost type. However, the switching driver 15 is not limited to the DC-DC converter, and may include another-type converter such as a buck converter, a fly-back converter, etc. The switching driver 15 operates so that the magnitude of the first current I1 output to the light source 13 can reach a predetermined target value Iref.

The switching driver 15, as shown in FIG. 4, includes a switching device 151 realized by a metal oxide semiconductor field effect transistor (MOSFET) or the like; an inductor 152, a diode 153, a capacitor 154, a first resistor 155, and a PWM controller 156. The PWM controller 156 detects the first current I1 that flows in the first resistor 155 and has the same magnitude as the first current I1 output to the light source 13, and controls the switching device 151 to make the first current I1 reach the target value Iref.

Since the switching driver 15 includes the inductor 152 and the capacitor 154, there may be a response delay in the first current I1 itself due to time taken in natural discharge of the inductor 152 and the capacitor 154 when to decrease the output first current I1. For example, in the case that the analog dimming method is applied to the switching driver 15, the first current I1 itself output corresponding to a square-wave analog dimming signal may have the response delay in a falling edge (refer to FIG. 5).

Further, the light source driver 14 includes the current bypasser 16 that bypasses at least a part (see I3 of FIG. 4, hereinafter, referred to as a "bypass current") of the first current I1 output from the switching driver 15. In this embodiment, at least a part I3 of the first current I3 may correspond to a difference between the first current I1 output from the switching driver 15 and the target value Iref In this case, the second current I2 flowing in the light source 13 more quickly reaches the target value Iref than the first current I1.

According to an exemplary embodiment of the present invention, the current bypasser 16 may include a transistor 161, a differential amplifier 162, an error amplifier 163, and a second resistor 164. The transistor 161 is connected in parallel with the light source 13, and may be realized as the MOSFET. The second resistor 164 is provided for detecting the second current I2 flowing in the light source 13, and connected in series with the light source 13. The differential amplifier 162 detects a voltage difference V1-V2 across the second resistor 164, and outputs a first voltage Vd corresponding to the second current I2 flowing in the light source 13.

The error amplifier 163 controls the transistor 161 to decrease difference between the first voltage Vd output from the differential amplifier 162 and the second voltage Vref corresponding to the target value Iref. In the present embodiment, the error amplifier 163 controls the transistor 161 so that the difference between the first voltage Vd and the second voltage Vref can become 0, or the first voltage Vd can be equal to the second voltage Vref In other words, the error amplifier 163 controls the transistor 161 so that the difference between the second current I2 and the target value Iref can become 0 or the second current I2 can be equal to the target value Iref.

The error amplifier 163 adjusts a gate voltage of the transistor 161 to thereby control the magnitude of the bypass current I3. The error amplifier 163 increases the gate voltage of the transistor 161 so that the magnitude of the bypass current I3 can become higher as the second current I2 is higher than the target value Iref, i.e., as the difference between the second current I2 and the target value Iref is larger. In this case, as polarity shown in FIG. 4, the first voltage Vd of the differential amplifier 162 is output to a positive terminal (+) of the error amplifier 163, and the second voltage Vref corresponding to the target value Iref is connected to a negative terminal (−) of the error amplifier 163.

The transistor 161 controlled by the error amplifier 163 operates in a forward active region. In the forward active region, the transistor 161 has a faster dynamic characteristic than the switching driver 15. The error amplifier 163 is described as an example of a transistor controller according to an embodiment of the present invention.

The bypass current I3 corresponds to a part of the first current I1, which exceeds the target value Iref due to a slow response of the switching driver 15, when the first current I1 is required to decrease, and flows toward the transistor 161 by bypassing the light source 13. Thus, the second current I2 flowing in the light source 13 is substantially equal to a value obtained by subtracting the bypass current I3 from the first current I1, so that the second current I2 can very quickly reach the target value.

Figure 1:
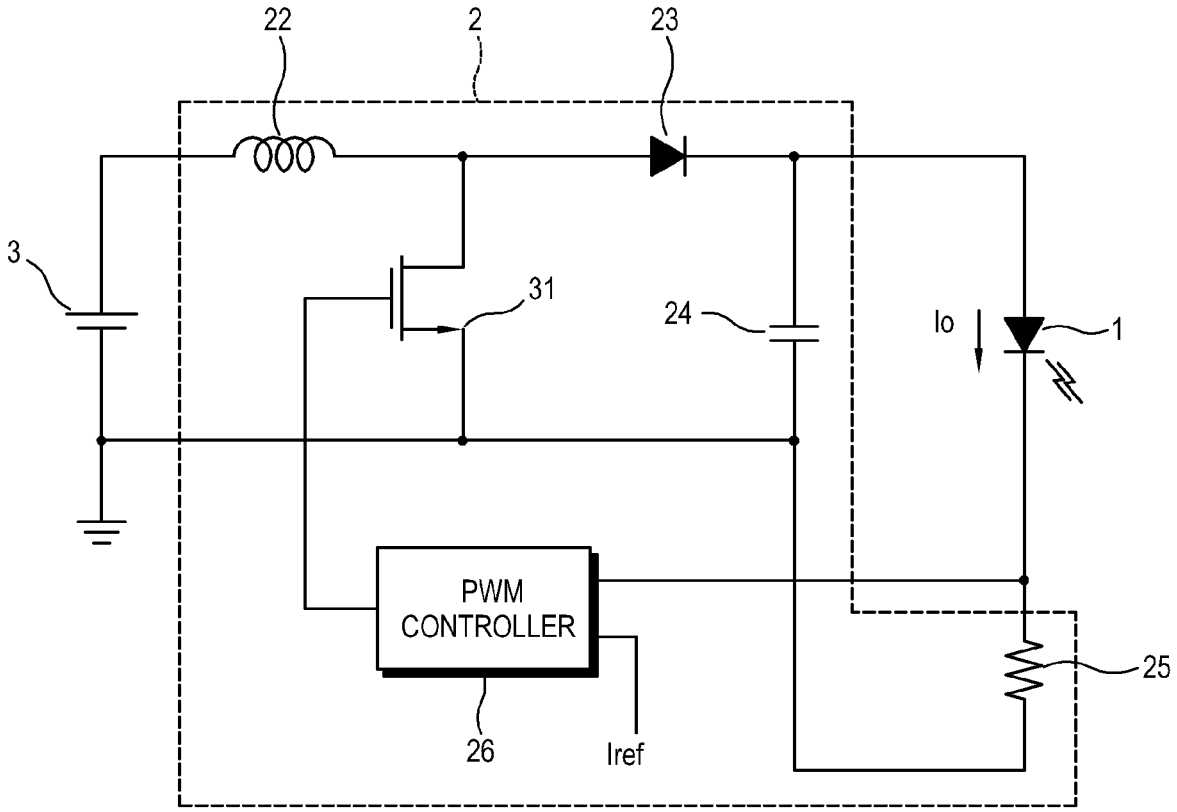
FIG. 1 (RELATED ART)
FIG. 1 shows a conventional switching-type light source driving circuit.
Figure 2:
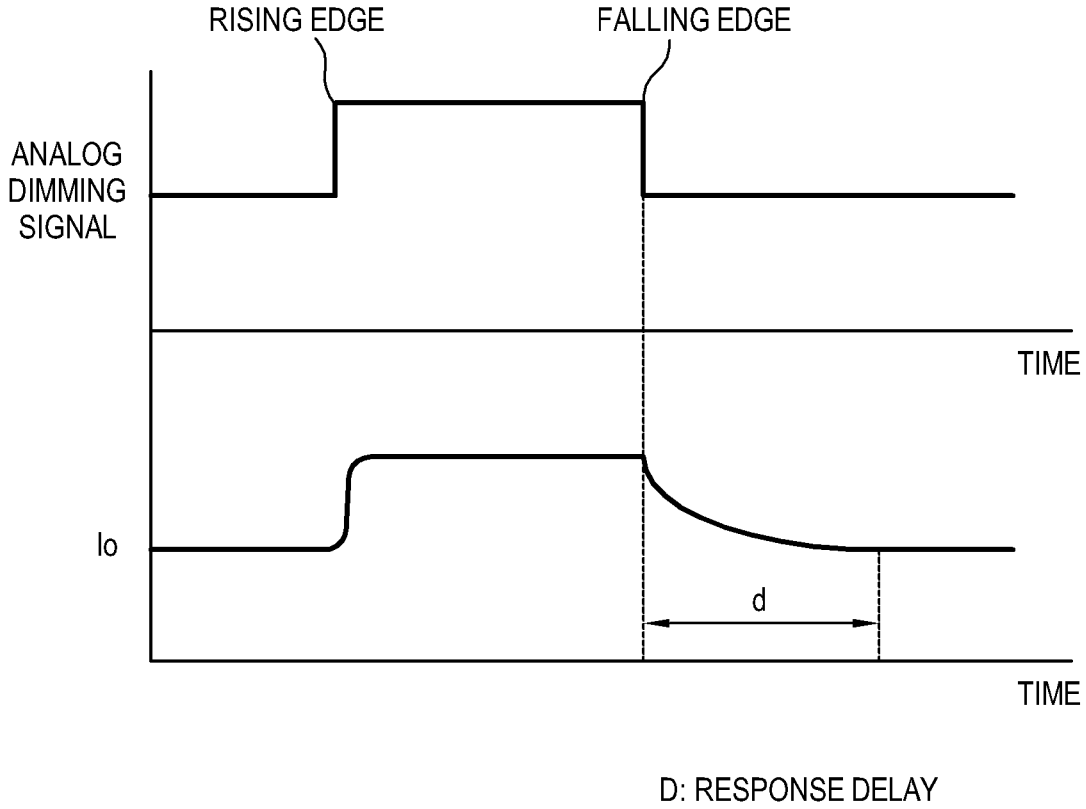
FIG. 2 (RELATED ART)
FIG. 2 shows a waveform of an output current from the light source driving circuit of FIG. 1.
Figure 5:
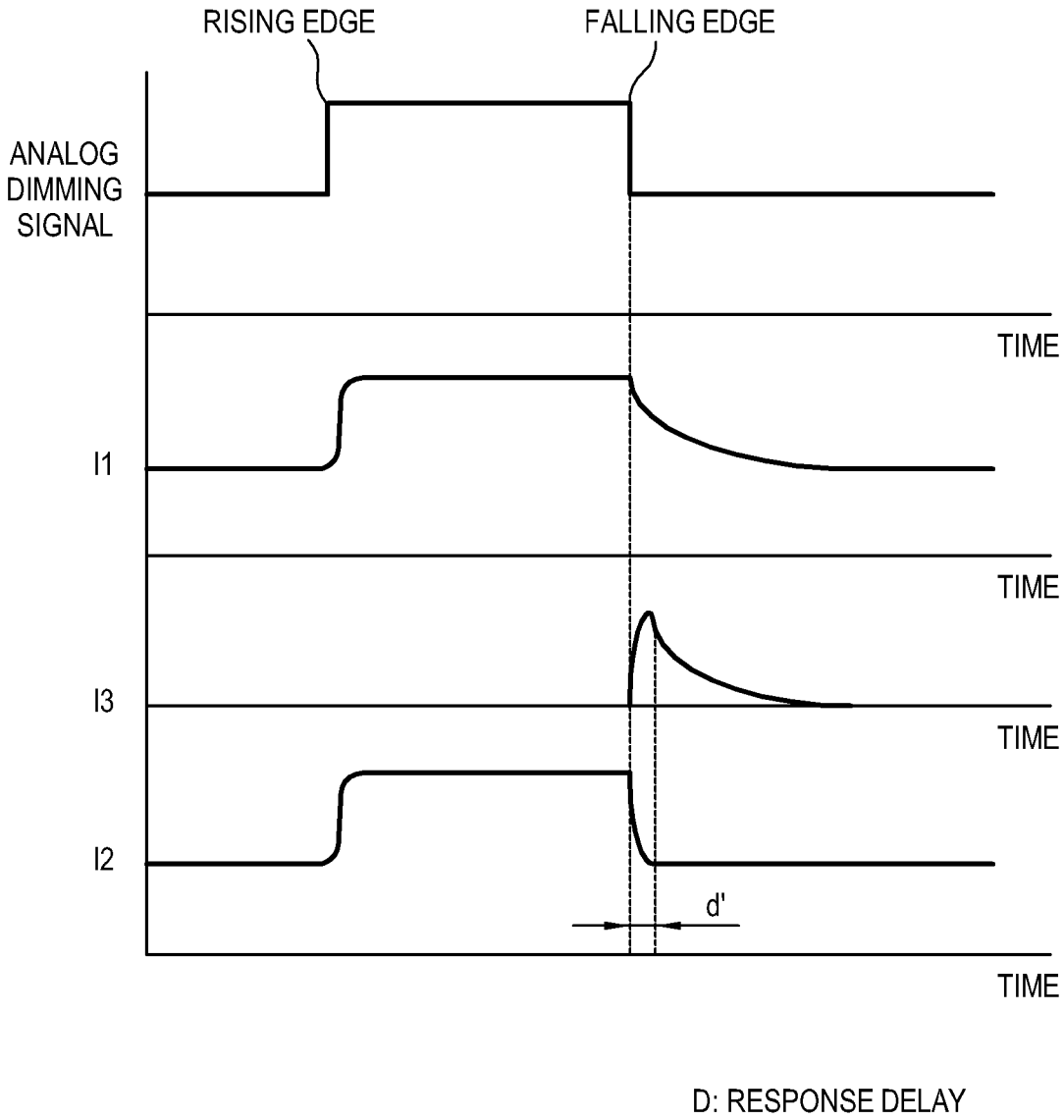
FIG. 5 is a waveform of an output current from the light source driver in FIGS. 3 and 4.

Referring to FIG. 5, in a falling edge of the square-wave analog dimming signal, the second current I2 flowing in the light source 13 is equal to a value obtained by subtracting the bypass current I3 from the first current I1. This shows that a response delay d' according to an embodiment of the present invention is remarkably decreased as compared with the conventional response delay d of FIG. 2. Accordingly, the response delay of the output current, which was at conventional issue, is remarkably reduced by the current bypasser 16 while maintaining superior characteristics in efficiency and heat-generation of the switching driver 15 to be driven in a switching manner.

In the falling edge of the square-wave analog dimming signal, detailed operations of the switching driver 15 and the current bypasser 16 are as follows. Before the analog dimming signal reaches the falling edge, the first current I1 is substantially equivalent to not only the second current I2 but also the target value Iref Thus, the difference between the first voltage Vd and the second voltage Vref is null, so that the transistor 161 can be turned off and the bypass current I3 cannot flow.

Then, when the analog dimming signal begins to enter the falling edge, the switching device 151 keeps open since the switching driver 15 itself cannot decrease an exceeding current. Relatively, the first current I1 starts to gradually decrease to the target value Iref, and at this time the error amplifier 163 bypasses the bypass current I3 corresponding to the difference between the first voltage Vd and the second voltage Vref so as to make the bypass current I3 flow in the transistor 162 since the second current I2 is higher than the target value Iref, i.e., the difference between the first voltage Vd and the second voltage Vref is not null.

Thus, the second current I2 is very quickly reduced by the bypass current I3. When the second current I2 reaches the target value Iref, i.e., when the difference between the first voltage Vd and the second voltage Vref becomes null, the error amplifier 163 continuously controls the transistor 161 to maintain this state. During this state, the exceeding current of the switching driver 15 is naturally discharged, so that the first current I1 reaches the target value Iref When the first current I1 reaches the target value Iref, the error amplifier 163 completely turns off the transistor 161, so that the bypass current I3 becomes null. In result, the second current I2 flowing in the light source 13 becomes the target value Iref.

On the contrary, when the first current I1 is required to increase, the second current I2 is lower than the target value Iref, so that the transistor 161 is turned off by the error amplifier 163 and does not perform any operation. The second current I2 is increased to reach the target value Iref by an active operation of the switching driver 15.

As described above, according to an exemplary embodiment of the present invention, when a light source of which light quantity is adjustable by controlling an electric current is driven, response characteristics of an output current are improved while maintaining good efficiency and heat-generation characteristics.

Although a few exemplary embodiments of the present invention have been shown and described, it will be appreciated by those skilled in the art that changes may be made in these embodiments without departing from the principles and spirit of the invention, the scope of which is defined in the appended claims and their equivalents.

For example, in the above-description, only the analog dimming method is exemplified, but not limited thereto. Alternatively, the present invention may be applied to the PWM dimming method.

Further, in the foregoing embodiment, the error amplifier 163 is realized as the transistor controller, but not limited thereto. Alternatively, the transistor controller may be achieved by a microcomputer that controls the transistor 161 to make the bypass current I3 as much as the difference between the first current I1 and the target value Iref In this case, the magnitude of the bypass current I3 or the gate voltage of the transistor 161 may be previously designed and set to correspond to the difference between the first current I1 and the target value Iref, and its data may be stored as a lookup table in a memory.

Also, in the above-described embodiment, an effect of the present invention is exemplified in enhancement of the response characteristic at the falling edge of the dimming signal, but not limited thereto. Alternatively, it is possible to enhance the response characteristic at any part of the dimming signal. For example, even if any factor may cause an exceeding response such as overshoot at a rising edge due to an unstable control operation of the switching driver 15, an overshoot part of the first current I1 exceeding the target value Iref is removed by the current bypasser 16, and the second current I2 becomes rectified, thereby further improving the response characteristic.

What is claimed is:

1. A light source driving apparatus for driving a light source, the apparatus comprising:

a switching driver which outputs a first current toward the light source; and a current bypasser which bypasses at least a portion of the first current so that a second current branched from the first current flows in the light source, the at least a portion of the first current corresponding to a difference between the first current and a target value corresponding to an input voltage of the switching driver; wherein a magnitude of the at least a portion of the first current is set to make the second current reach the target value;

the light source driving apparatus characterized in that:

the current bypasser comprises:

a resistor which is connected in series with the light source;

a transistor which is connected in parallel with the series connection of the light source and resistor;

a differential amplifier which detects a voltage difference across the resistor and outputs the voltage difference as a first voltage; and a transistor controller receiving the first voltage and controlling the transistor to operate in a forward active region so that the at least a portion of the first current flows in the transistor to thereby decrease a difference between the first voltage and the input voltage of the switching driver, so as to drive the second current toward the target value.

2. The light source driving apparatus according to claim 1, wherein a magnitude of the at least a portion of the first current is set to make the second current reach the predetermined target value.

3. The light source driving apparatus according to claim 1, wherein the switching driver performs at least one of analog dimming and pulse width modulation (PWM) dimming to control the quantity of the light.

4. The light source driving apparatus according to claim 1, wherein the light source comprises at least one light emitting diode (LED).

5. A method of driving a light source, comprising:

outputting a first current toward the light source; and bypassing at least a portion of the first current so that a second current branched from the first current flows in the light source, the at least a portion of the first current corresponding to a difference between the first current and a target value corresponding to an input voltage of a switching driver; wherein a magnitude of the at least a portion of the first current is set to make the second current reach a target value;

the method characterized in that:

the bypassing of the at least a portion of the first current comprises:

connecting a resistor in series with the light source;

connecting a transistor in parallel with the series connection of the resistor and the light source;

detecting, at a differential amplifier, a voltage difference across the resistor and outputting the voltage difference as a first voltage; and controlling the transistor to operate in a forward active region so that the at least a portion of the first current flows in the transistor to thereby decrease a difference between the first voltage and the input voltage of the switching driver, so as to drive the second current toward the target value.

6. The method according to claim 5, wherein a magnitude of the at least the portion of the first current is set to make the second current reach the predetermined target value.

7. The method according to claim 5, wherein the outputting comprises performing at least one of analog dimming and pulse width modulation (PWM) dimming to control the quantity of the light.

8. The method according to claim 5, wherein the light source comprises at least one light emitting diode (LED).

9. A display apparatus comprising:

a video processor which processes an image;

a display unit which displays the image processed by the video processor;

a light source which illuminates the display unit with light; and a light source driver which drives the light source to control a quantity of the light emitted from the light source, the light source driver comprising:

a switching driver which outputs a first current toward the light source; and a current bypasser which bypasses at least a portion of the first current so that a second current branched from the first current flows in the light source, the at least a portion of the first current corresponding to a difference between the first current and a target value corresponding to an input voltage of the switching driver; wherein a magnitude of the at least a portion of the first current is set to make the second current reach the target value;

the light source driving apparatus characterized in that:

the current bypasser comprises:

a resistor which is connected in series with the light source;

a transistor which is connected in parallel with the series connection of the light source and resistor;

a differential amplifier which detects a voltage difference across the resistor and outputs the voltage difference as a first voltage; and a transistor controller receiving the first voltage and controlling the transistor to operate in a forward active region so that the at least a portion of the first current flows in the transistor to thereby decrease a difference between the first voltage and the input voltage of the switching driver, so as to drive the second current toward the target value.

10. The display apparatus according to claim 9, wherein a magnitude of the at least the portion of the first current is set to make the second current reach the predetermined target value.

11. The display apparatus according to claim 9, wherein the switching driver performs at least one of analog dimming and pulse width modulation (PWM) dimming to control the quantity of the light.

12. The display apparatus according to claim 9, wherein the light source comprises at least one light emitting diode (LED).

* * * * *